US006554237B1

(12) United States Patent
Weber et al.

(10) Patent No.: US 6,554,237 B1
(45) Date of Patent: Apr. 29, 2003

(54) SELF ALIGNING CURTAIN ROD BRACKET

(76) Inventors: Michael P. Weber, 1633 Alpine Dr., Pen Argyl, PA (US) 18072; David J. Simmons, 3864 Courtney St., Suite 220, Bethlehem, PA (US) 18017

( * ) Notice: Subject to any disclaimer, the term of this patent is extended or adjusted under 35 U.S.C. 154(b) by 0 days.

(21) Appl. No.: 09/565,789

(22) Filed: May 5, 2000

(51) Int. Cl.[7] ..... A47H 1/10
(52) U.S. Cl. ..... 248/261; 248/205.3
(58) Field of Search ..... 248/264, 261, 248/262, 205.3, 220.1, 208

(56) References Cited

U.S. PATENT DOCUMENTS

| | | | | | |
|---|---|---|---|---|---|
| 722,387 | A | * | 3/1903 | Scott | |
| 1,384,273 | A | * | 7/1921 | Palosky | |
| 2,703,693 | A | * | 3/1955 | Cropanese | 248/264 |
| 3,409,257 | A | * | 11/1968 | Elm | 248/205.3 |
| 3,800,449 | A | * | 4/1974 | Minatodani | 248/205.3 |
| 3,907,240 | A | * | 9/1975 | Belli | 248/264 |
| 4,283,034 | A | * | 8/1981 | Sheehan | |
| 4,341,254 | A | * | 7/1982 | Schaller | |
| 4,762,162 | A | * | 8/1988 | Chochrek | |
| 4,840,337 | A | * | 6/1989 | Zaugg | 248/205.3 |
| 4,961,296 | A | | 10/1990 | Morehouse | 52/37 |
| 5,082,226 | A | * | 1/1992 | Mahan | |
| 5,230,494 | A | | 7/1993 | Adams | 248/266 |
| 5,564,666 | A | * | 10/1996 | Pfeil | 248/264 |
| 5,577,700 | A | | 11/1996 | Williams, Jr. | 248/261 |
| 5,887,830 | A | * | 3/1999 | Liang | 248/205.3 |

FOREIGN PATENT DOCUMENTS

| | | | | |
|---|---|---|---|---|
| GB | 2098053 | * | 11/1982 | 248/261 |

* cited by examiner

*Primary Examiner*—Alvin Chin-Shue
(74) *Attorney, Agent, or Firm*—Duane Morris, LLP

(57) ABSTRACT

A curtain rod mounting bracket is affixed adhesively via a front mounting plate and a side mounting flange to be abutted against the upper inside corner of a window or other framed opening. The front mounting plate extends outwardly from the opening and the side mounting flange extends partway along the height of the front plate and extends rearwardly generally perpendicular to the front plate. One or more curtain rod support hooks are placed at the upper outside edge of the front plate. Relatively thick double sided adhesive strips are attached to the window frame side of the side flange and front mounting plate, securing the bracket to the window frame without damage, and allowing for alignment correction due to an imperfectly squared window frame and/or non-rectilinear moldings.

12 Claims, 5 Drawing Sheets

SELF ALIGNING CURTAIN ROD BRACKET

BACKGROUND OF THE INVENTION

1. Field of the Invention

This invention relates to mounting apparatus for attachment to wall moldings that frame an opening, to support and correctly position rod elements for carrying curtains, valences and similar window treatments. A bracket having a positioning flange extending into the opening is attachable to the front and inner surfaces of a framed opening, via resilient adhesive pads, thereby preventing damage. The pads have a thickness permitting the bracket to be adjusted in mutually perpendicular directions such that the bracket can accommodate the slope and contour of the molding or support frame, positioning the bracket and therefore the curtain rod correctly relative to the inside corner of the frame.

2. Prior Art

It is often desirable to cover windows, doors and similar framed openings with is curtains or blinds of various types. The window or door is defined by a frame which may include a bordering molding mounted to the frame around the opening. The typical molding is tapered in thickness and protrudes from the wall surface to a greater extend proceeding away from the edge of the opening.

It is customary to attach fixtures on the lateral sides of the opening, for example at the top, for holding the ends of a curtain rod to support curtains that depend across the opening. Venetian blinds are similarly mounted, typically by box-like brackets. Brackets for mounting rods for depending curtains, valences and the like commonly have a flat base plate with openings to receive one or more nails, screws or the like, which are driven or threaded into the molding to fix the bracket in position on opposite sides of the door or window frame. One or more hooked arms extends forward and typically upward from the base plate, and engages in the hollow curtain rod via a hole spaced from the end of the rod near an L-shaped bend at each end of the rod.

According to one type of bracket, the base plate is integral with a side mounting plate that extends rearwardly from the flat base plate to wrap around the outer corner of the molding surrounding the frame. The side mounting plate can also have one or more openings for receiving fasteners such as nails or screws. Brackets with side mounting plates are useful in that the side mounting plates inherently position the curtain rod hooks at a given position relative to the outer edge of the molding. However, this feature is not available for framed openings that do not have a protruding molding defining such outer edge.

A problem with certain curtain rod brackets having a side mounting plate is that the bracket can be conspicuously visible and can interfere with the aesthetic appeal of the window treatment. An additional problem with this type of bracket is that the relatively permanent nails or screws used as fasteners produce holes in the molding and the brackets are often painted over. When the brackets or their positions are changed, nail or screw holes in the molding or frame, and any unevenness in the painted surface, require repairs.

An attempt to provide an improved support bracket is disclosed in U.S. Pat. No. 4,283,034—Sheehan, which discloses a bracket having a rearwardly extending flange which extends over the upper and outer edge of the molding. The flange has tangs which are driven into the top of the molding. Sheehan avoids damage to the front of the molding but requires that the bracket be hung by penetrating the molding from above. The tangs have a wider surface area than a screw or nail and create a larger hole. The bracket is fastened to the molding in a manner which bears vertical force but can only prevent downward and horizontal displacement of the bracket. Upward vertical force can unseat the bracket from the molding.

Further examples of brackets for mounting curtain rods are disclosed in U.S. Pat. Nos. 5,577,700—Williams and 5,230,494—Adams. Williams discloses a bracket which has a sideways extending flange with apertures for receiving nails and screws. The bracket is fixed in place by nailing or screwing the flange to the wall adjacent the molding. Williams avoids damage to the molding at the expense of the wall which is often comprised of more fragile materials such as plaster or dry wall. Attaching screws or nails into dry wall often requires attention to cracking, or expandable screw fittings such as mollies or toggle screws. Adams discloses a bracket which is mounted on an array of suction cups. The suction cups are attached directly to the window. In addition to creating an aesthetically unappealing situation, this type of product cannot be used with windows that open outwardly on a hinge axis.

In general, mounting brackets are not well suited to being mounted on the surfaces of contoured moldings. When a molding around a window or door is substantially rectilinear and has a flat facing surface, the bracket orients the rod hooks directly forwardly when resting flush against the molding. However, most moldings are angled such that they are thinner at the edge of the opening and thicker progressing outwardly. Moldings also are often rounded or otherwise contoured. A contoured or sloped molding at best causes the bracket to rest awkwardly on the molding (for example against a limited width of molding material) and may misalign the rod hooks such that it is difficult to place and remove the rod. Brackets can be shaped to complement the contour of moldings. However, the bracket must be customized to the molding and may be impractical for uncommon molding patterns.

It would be desirable to provide a curtain rod bracket which when mounted is substantially concealed, avoids damage to the wall or frame and particularly to the wall adjacent to an opening framed by a molding, and is adjustable as well as self-positioning to accommodate the contour of the molding.

SUMMARY OF THE INVENTION

It is an object of the invention provide a bracket for supporting curtain rods which is substantially concealed when mounted and supporting a curtain.

It is also an object of the invention to provide a bracket for supporting curtain rods and hangers which is adjustable to conform to sloped or otherwise contoured moldings.

It is a further object of the invention to provide a bracket for supporting curtain rods and hangers which does not damage the frame or molding of a door or window.

It is another object of the invention to provide a bracket as described that additionally has self-positioning structures that abut inside edges and surfaces of a framed opening.

These and other objects are accomplished by a bracket comprised of a front mounting plate and a side mounting flange which extends rearwardly from the front mounting plate at substantially a right angle. At least one rod support arm is located in the upper outside corner of the front mounting plate and extends forwardly in a plane parallel to the side mounting flange. The support arm has a horizontal bearing surface for supporting the weight of a curtain rod that is hollow at an end facing the bracket. A knob protrudes upwardly from the bearing surface and mates with a corresponding aperture in the curtain rod such that the arm and knob constrain the curtain rod from moving in a horizontal direction or from rotating downwardly when mounted. The knob can alternatively be formed as the end of an upwardly curved hook shaped arm extending outwardly from the front mounting plate.

Adhesive bonding pads are attached to the surfaces of the side flange and front mounting plate facing the edges of the opening, the pads comprising relatively thick resilient material with adhesive on both sides for securing the curtain rod mounting device to the window frame. The adhesive strip can be provided in different or tapering thicknesses. The adhesive strip is compressible to compensate for ridges encountered in contoured molding and/or to accommodate variations in the surface configuration or orientation of the edges of the opening. Alternatively or in addition, the bracket can comprise a flexible or malleable material which allows the front mounting plate and the side mounting flange to be bent relative to each other to match the slope and contour of the molding.

The top edges of the side mounting flanges for a bracket on each lateral side of the opening is abutted into the respective upper corner of the framed opening as the bracket is mounted. The bracket is simultaneously leveled and affixed to the inside wall of the opening and to the outer surface (e.g., to the face of the molding surrounding the opening). This registers both brackets to the upper edge of the opening and positions the rod engaging hooks at an equal height and distance from the edge of the opening.

In order to hang curtains, two brackets are mounted to the molding in opposite upper corners of the door or window frame. The front mounting plate is juxtaposed to the molding of the door or window so that the side mounting flange extends along the inner part of the door frame perpendicular to the plane of the window. The slotted ends of a curtain rod are then mated with the support arms of the bracket. The registered placement of the support arms in the upper outer corner of the front mounting plates causes the curtain rod to extend across the top of the opening and parallel to its upper edge. The support arms are preferably placed at the extreme outer edge of the mounting plate, and accordingly when curtains are placed on the rod, the bracket is concealed from view.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims.

In the drawings.

DETAILED DESCRIPTION OF THE PREFERRED EMBODIMENTS

Figure 1:
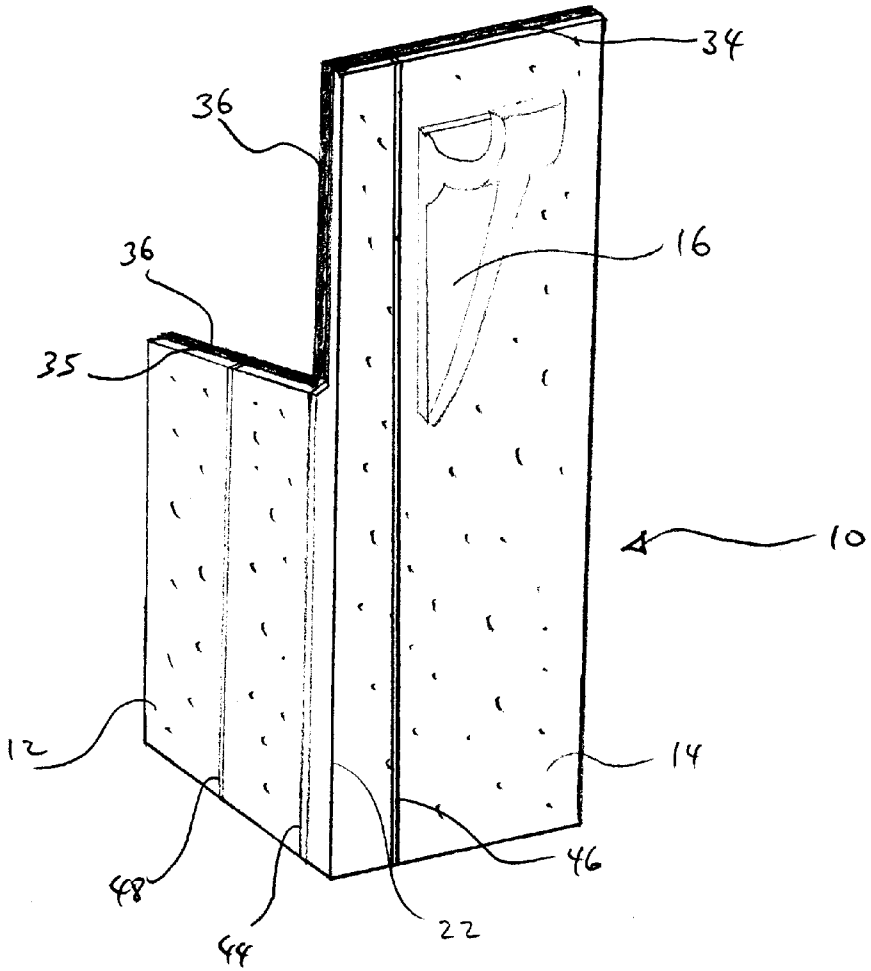
FIG. 1 is a front perspective view of the mounting bracket embodying the invention.

The invention is described in detail with reference to the accompanying drawings in which the same reference numerals are used throughout to identify corresponding elements. FIG. 1 shows the curtain rod mounting bracket 10 according to the invention. The mounting bracket 10 can be constructed from a flexible material such as polyvinyl chloride, high impact polystyrene or another type of durable plastic. Alternatively, the bracket can be made of a malleable metal such as aluminum or brass. Bracket 10 also may be constructed from other materials such as wood. As formed of plastic, bracket 10 can be a single piece injection molded part integrally formed with a front mounting plate 14 for attachment to the facing wall surface adjacent to a window or similar framed opening, a side mounting flange 12 perpendicular thereto for extending into the opening and attaching to an inner side wall, and at a pair of outwardly extending laterally spaced support arms 16 for receiving the end of a curtain rod or the like. The side mounting flange 12 extends rearwardly from the outer edge 22 of front mounting plate 14 over only a lower part of the height of plate 14. Support arms 16 extend outwardly from the upper outer corner of front mounting plate 14 such that the curtain rod is placed at the extreme edge of the bracket.

Figure 2:
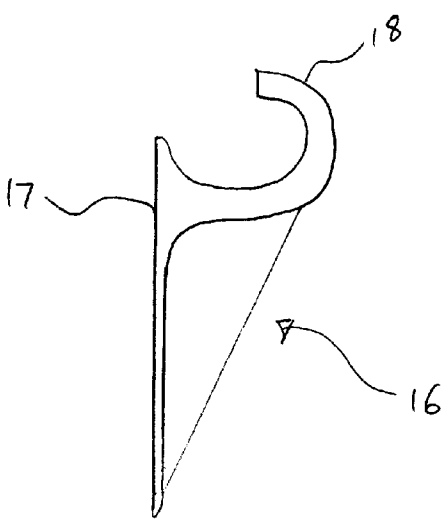
FIG. 2 is a side elevational view of a support arm of the mounting bracket of FIG. 1.

As shown in FIG. 2, support arms 16 each have a horizontal bearing surface 17 which supports the weight of curtain rods. Protruding upwardly from bearing surfaces 17 are knobs 18 which mate with a corresponding aperture in the hollow curtain rod and prevents the curtain rod from moving in a horizontal direction or rotating downwardly due to cantilevered weight carried by the curtain rod, i.e., the weight of the curtain and any downward force applied to the curtain.

Figure 6:
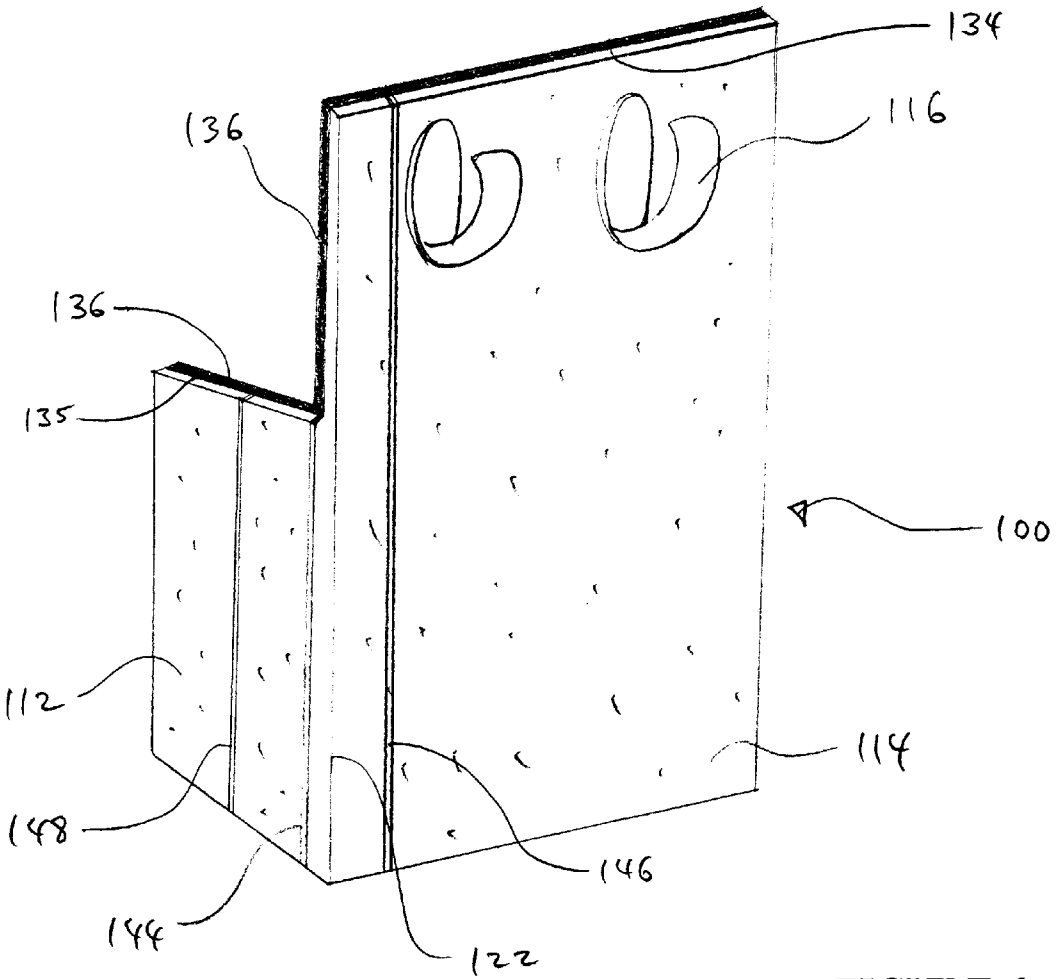
FIG. 6 is a front perspective view showing an alternative embodiment of the mounting bracket; and, FIG. 7 is a side elevational view of a support arm of the mounting bracket of FIG. 6.

An alternative configuration is shown in FIG. 6, wherein a pair of curved hooks 116 extend outwardly from the front mounting plate 114 to form the arms. The curved hooks 116 are particularly adapted to receive a tubular curtain rod. Support arms 16 and hooks 116 preferably are integral with brackets 10 and 100 respectively. However, hooks 116 and arms 16 can be provided as a separately attached part affixed to front mounting plates 14, 114 by adhesive or by means of a mechanical fastener such as a screw, rivet or the like.

As shown in FIGS. 1 and 6, front mounting plates 14, 114 and side mounting flanges 12, 112 have rear surfaces 34, 134 and 35, 135 respectively which have attachment strips 36, 136 mounted thereto. Attachment strip 36, 136 comprises a relatively thick compressible pad having an adhesive bonding agent on both sides. Strips 36, 136 adhere to the rear surfaces 34, 134 and 35, 135 of brackets 10, 100 and to the molding and inside wall of a door or window frame. The compressible pad allows the brackets 10, 100 to be better positioned on unevenly contoured molding surfaces and door frames, and accommodates edges that are not precisely plumb, up to the compressible thickness of the pads. For example, the pads can be approximately 3/16 inch (5 mm) thick at rest, and readily compressible to 1/16 inch (1.6 mm) when mounted. Whereas the adhesive pads are placed on mutually perpendicular surfaces, either of the pads will remain compressed when mounted because resilient forces normal to the surface, produced by compression of that pad, are resisted substantially along the plane of attachment of the other pad.

Figure 3:
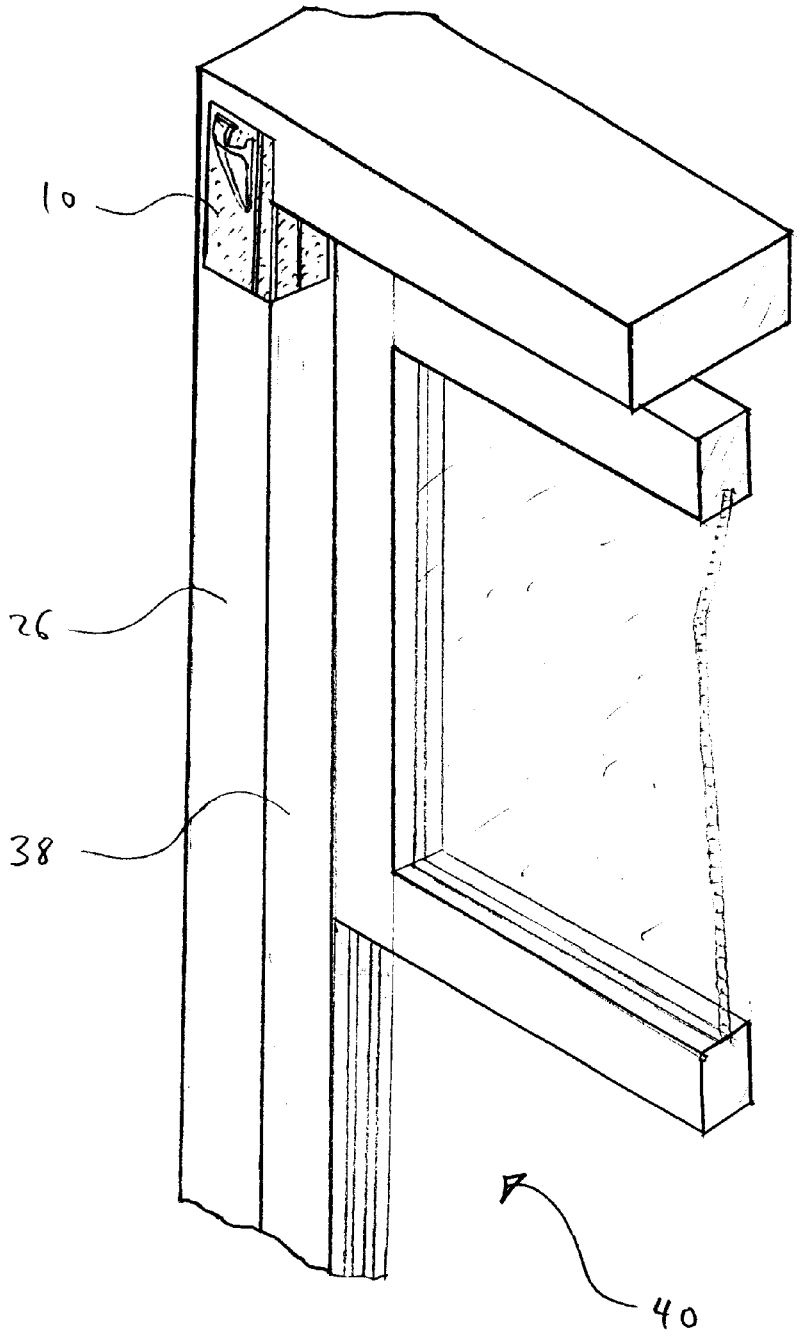
FIG. 3 is a front perspective view of a conventional window frame without molding, having an opposite-hand embodiment of the mounting bracket of FIG. 1 mounted thereto.
Figure 4:
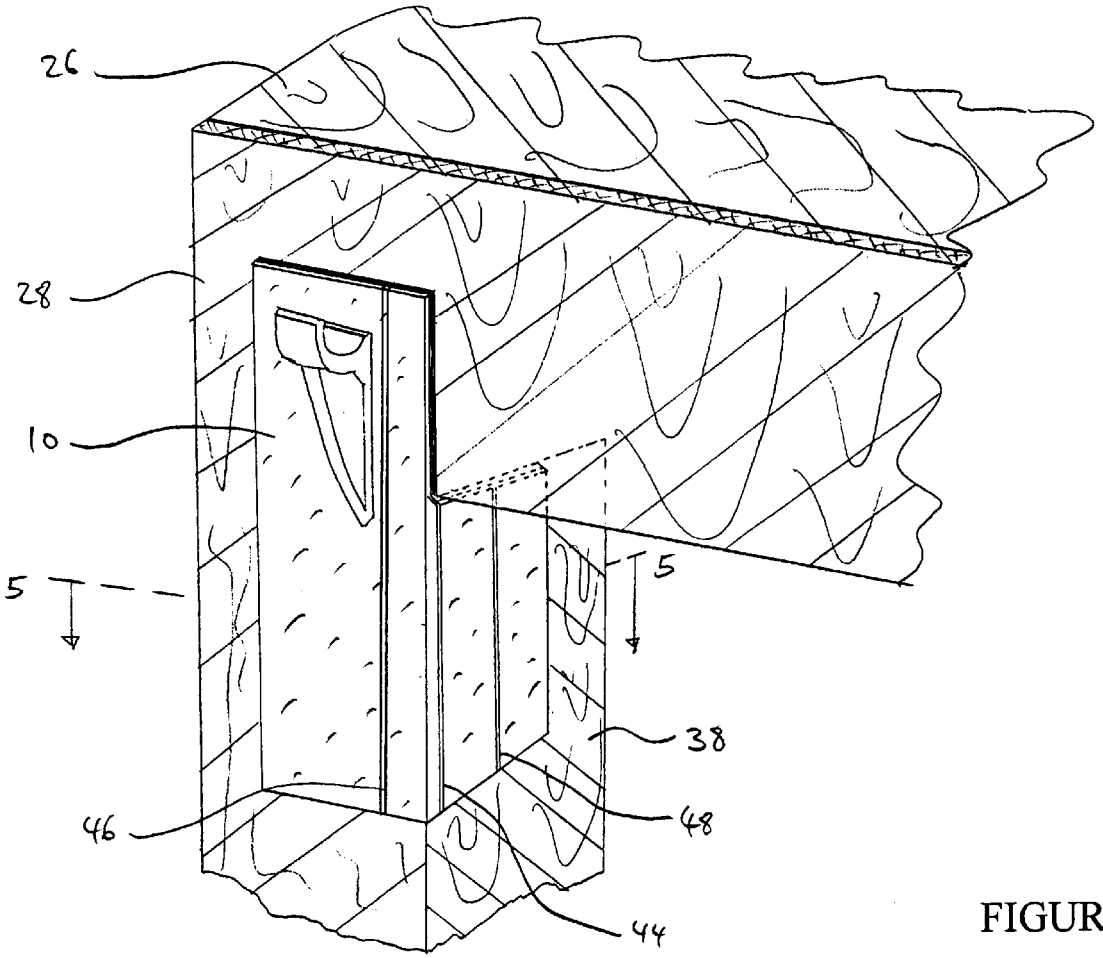
FIG. 4 is a front perspective view of a corner of a conventional window frame with molding, having an opposite-hand embodiment of the mounting bracket of FIG. 1 mounted thereto.
Figure 5:
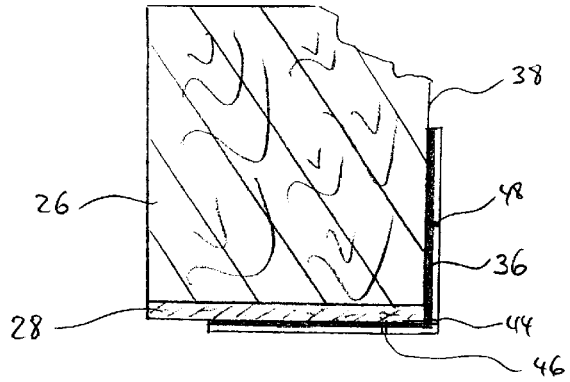
FIG. 5 is a sectional view taken along line 5—5 of FIG. 4.
Figure 5B:
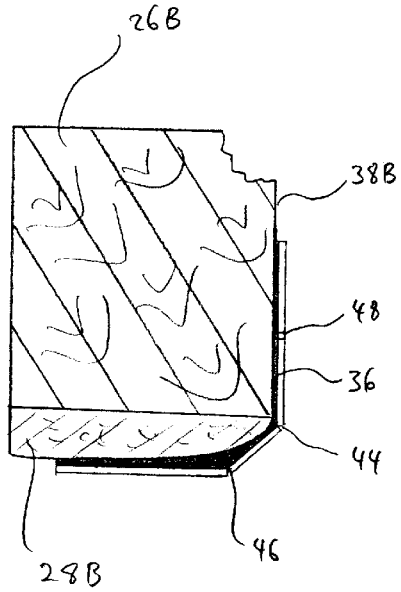
FIG. 5B is a sectional view similar to FIG. 5, showing the mounting bracket mounted to a contoured molding.
Figure 5A:
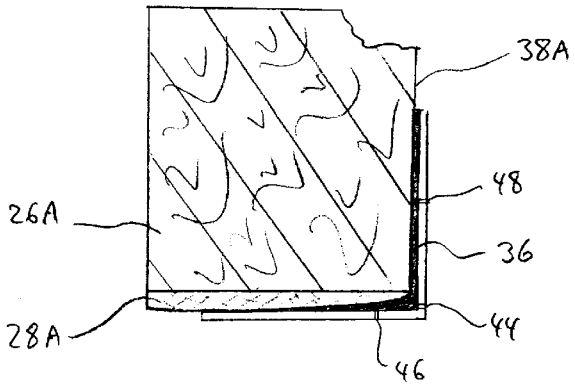
FIG. 5A is a sectional view similar to FIG. 5, showing the mounting bracket mounted to a slightly contoured molding.
Figure 7:
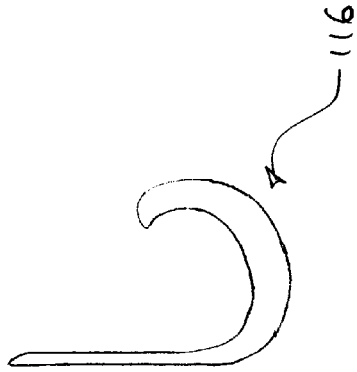

FIG. 3 illustrates a typical window frame structure without molding, in which a frame 26 is disposed in a wall and defines an opening 40. The framed opening is typically occupied by a window or door, but could also be a different type such as an alcove, a framed painting, etc. FIG. 4 shows a corner of a conventional window frame with molding, wherein the decorative molding 28 is attached to the face of the frame 26 adjacent the inner face or periphery 38 of frame 26. Decorative molding 28 can be flat and square, but typically is tapered for greater thickness proceeding outwardly, and can be decoratively contoured. For illustrating operation of the invention, FIGS. 4 and 5 show frame 26 having a flat molding 28 and FIG. 5A shows a slightly sloped contoured molding 28A along the door frames 26, 26A adjacent the inner periphery 38, 38A. As described above, attachment strip 36 fastens bracket 10 to the molding 28, 28A and comprises compressible padding which is coated with an adhesive on two sides. The compressible padding of strip 36 allows for compensation in the elevational differences in the ridges of the contoured molding 28A. As shown in FIG. 5A, the attachment strip 36 is compressed along the outside of molding 28A and remains fully expanded along the inside of molding 28A. This keeps the rear surface 34 of front mounting plate 14 positioned against the contoured molding 28A.

There are instances when the slope and contour of molding are such that attachment strips cannot compensate for the elevational differences in the contoured molding. Two options are available to remedy this situation. For common molding contours, the rear surface 34 can be contoured to complement the molding. Alternatively and as illustrated in FIG. 5B, the side mounting flange 12 can be bent relative to the front mounting plate 14 to better match the slope of the molding. The attachment strip 36 lessens the amount of bending which must occur in order to match the slope of the molding 28B and also conforms to steps and irregularities in the surface. Once the side flange 12 is bent, the front mounting plate must be bent to ensure that the support arms 16 are properly oriented in a direction perpendicular to door frame 26. The mounting bracket 10 includes creases 44, 48 and 46 which allow for bending of the side mounting flange 12 and the front mounting plate 14, respectively.

In operation, a pair of brackets 10 are aligned in the upper corners of frame 26 so that the side mounting flange 12 is flush with the inner face 38 of frame 26 and the rear of front mounting plate 14 is flush with the molding, with the top edge of side mounting flange abutted against the top inside of the opening and the bracket set to plumb. As shown in FIG. 5, if bracket 10 is attached to flat molding 28, it is generally only necessary to align the rear surface 34 and press upon the front of bracket 10 which will bond the attachment strips 36 to the molding 28 and the inner face 38. As shown in FIG. 5B, if bracket 10 is to attach to sloped contoured molding 28B, the bracket 10 may need to be adjusted depending upon the grade of the slope. In most instances, the compressibly padded attachment strips 36 will compensate for elevational differences in the ridges of the contoured molding. For steep grades the bracket 10 is adjusted to match the grade of the molding by bending side mounting flange 12 relative to front mounting plate 14 along crease 44. Once the grade is matched, the front face of the bracket is pressed and attachment strip 36 will engage molding 30. If necessary, the front mounting plate 14 is then bent along crease 46 to align support arms 16 in a direction perpendicular to door frame 26.

A curtain rod is fitted with a curtain and placed on brackets 10, namely on one of the support arms 16, two being shown for mounting inner and outer curtain rods and curtains. The orientation of a curtain rod relative to bracket 10 is such that a rod extends parallel to the top edge of the opening across the tops of brackets 10 and to their extreme outer edges. Side mounting flange 12 is attached to the inner periphery 38 of the window frame, 26. Thus, when curtains are placed on the rod, the brackets are concealed behind the curtains.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A bracket for supporting a curtain rod at a point on an inside wall surface, above and laterally outside a corner of a framed opening in the wall, the corner being defined by said inside wall surface and by vertical and horizontal framed opening surfaces, said inside wall surface and said vertical and horizontal framed opening surfaces being mutually perpendicular and meeting at said corner, said bracket comprising:

a front mounting plate having a rear surface which is mounted flush against said inside wall surface, adjacent to the opening, said front mounting plate extending laterally outwardly from the corner and above and below the corner, on the inside wall surface;

a side mounting flange which depends rearwardly from said front mounting plate at a position spaced from an end of the front mounting plate, the side mounting flange having a rear surface that is perpendicular to the rear surface of the front mounting plate and is mounted flush against one of said vertical and horizontal framed opening surfaces, the side mounting flange having a top edge that is perpendicular to the front mounting plate and spaced from the end of the front mounting plate, the right angle edge being abutted against the other of said vertical and horizontal framed opening surfaces at the corner, for positioning and plumbing the bracket relative to the corner;

at least one support arm extending outwardly from a front surface of said mounting plate for engaging the curtain rod and positioning the curtain rod parallel to the horizontal framed opening surface; and a non-penetrating attaching means for securing said bracket to at least one of said inside wall surface and said vertical and horizontal framed opening surfaces.

2. The bracket of claim 1, wherein said attaching means comprises a pad having an adhesive bonding placed on a front and a rear face of said pad.

3. The bracket of claim 2, wherein said pad has a compressible thickness sufficient to accommodate a molding varying in thickness, on the inside wall surface adjacent to said vertical and horizontal framed opening surfaces.

4. The bracket of claim 1, wherein said at least one support arm further comprises a horizontal bearing surface to support a vertical weight of a rod and curtain assembly, and a tip protruding upwardly from said horizontal bearing surface to prevent slippage of said rod and curtain assembly from said horizontal bearing surface.

5. The bracket of claim 1, wherein said support arm comprises an upwardly curved hook extending from said front surface of said front mounting plate.

6. The bracket of claim 2, wherein said rear surface of said front mounting plate is substantially covered by said pad.

7. The bracket of claim 2, wherein said rear surface of said side mounting flange is substantially covered by said pad.

8. The bracket of claim 2, wherein said rear surface of said front mounting plate and said rear surface of said side mounting flange are both substantially covered by said pad.

9. The bracket of claim 1, wherein at least the front mounting plate and the side mounting flange of said bracket comprise integrally molded polyvinyl chloride.

10. The bracket of claim 1, wherein at least one of the front mounting plate and the side mounting flange defines at least one crease parallel to one of said vertical and horizontal framed opening surfaces, whereby the bracket is conformable to an angle of a molding.

11. The bracket of claim 10, wherein said crease is spaced from the side mounting flange along an edge of the front mounting plate.

12. The bracket of claim 1, wherein said front mounting plate is shaped to coincide with a contour of an unevenly contoured molding.

* * * * *